US012514427B2

(12) United States Patent
Kim et al.

(10) Patent No.: US 12,514,427 B2
(45) Date of Patent: Jan. 6, 2026

(54) DISHWASHER

(71) Applicant: LG ELECTRONICS INC., Seoul (KR)

(72) Inventors: Myeong Jin Kim, Seoul (KR); Sang Woo Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 399 days.

(21) Appl. No.: 18/091,833

(22) Filed: Dec. 30, 2022

(65) Prior Publication Data

US 2023/0210341 A1 Jul. 6, 2023

(30) Foreign Application Priority Data

Dec. 31, 2021 (KR) ..... 10-2021-0194346

(51) Int. Cl.
*A47L 15/48* (2006.01)
*A47L 15/42* (2006.01)

(52) U.S. Cl.
CPC ..... *A47L 15/486* (2013.01); *A47L 15/4212* (2013.01); *A47L 15/4246* (2013.01)

(58) Field of Classification Search
None
See application file for complete search history.

(56) References Cited

U.S. PATENT DOCUMENTS 3,807,420 A * 4/1974 Donselman ..... A47L 15/486 34/68
2008/0196751 A1 8/2008 Poyner et al.
2010/0192990 A1 8/2010 Hotz et al.

FOREIGN PATENT DOCUMENTS

DE 1135408 B 8/1962
EP 3000377 2/2017
IT TO20110841 A1 3/2013

OTHER PUBLICATIONS

ITTO20110841A1 translation (Year: 2013).*
EP Extended European Search Report in European Appln. No. 22215737.2, mailed on Jun. 1, 2023, 7 pages.

* cited by examiner

*Primary Examiner* — Rita P Adhlakha
(74) *Attorney, Agent, or Firm* — Fish & Richardson P.C.

(57) ABSTRACT

A dishwasher includes a tub in which dishes are stored, a base disposed below the tub, a dry air supplier configured to spray air to the tub, and a cover disposed to expose the dry air supplier through an opening formed in a bottom surface of the base and configured to close the opening by being coupled to the base.

20 Claims, 17 Drawing Sheets

DISHWASHER

CROSS-REFERENCE TO RELATED APPLICATION

This application claims priority to and benefit of Korean Patent Application No. 10-2021-0194346, filed on Dec. 31, 2021, which is hereby incorporated by reference as if fully set forth herein.

BACKGROUND

Technical Field

The present disclosure relates to a dishwasher, more particularly, a dishwasher including a dry air supplier.

Background of the Disclosure

Description disclosed in the background only provides background information on the present disclosure and may not constitute the prior art.

A dishwasher is an electric appliance configured to wash dishes provided as washing targets held therein by spraying wash water them. At this time, wash water used for dishwashing may include a dishwashing detergent.

A conventional dishwasher may include a tub configured to define a washing space, a storage part configured to receive a washing target inside the tub, a spray arm configured to spray wash water to the storage part, and a sump configured to store wash water and supply wash water to the spray arm.

By using the dishwasher, the time and effort required for washing dishes that are washing targets after eating may be reduced, thereby contributing to user's convenience.

In order to quickly dry washing targets that are washed in a dishwashing process using wash water, the dishwasher may include a structure configured to spray air to the washing targets.

EP 3000377 B1 discloses Prior art of a dishwasher having a structure configured to flow air in a washing space.

There is a need of providing a dry air supplier in the dishwasher to smoothly spray heated air, that is, dry air into the tub in which a washing target is stored and to save an inner space of the tub.

If it is heated, the dry air supplier might have a hot surface and the sprayed dry air is also high temperature. Accordingly, the dry air supplier may be disposed inside the dishwasher for user safety.

To check and repair the dry air supplier, it is necessary to remove the dry air supplier from the dishwasher. In this instance, for a worker's convenience it is necessary to facilitate the process of mounting and decoupling the dry air supplier in and from the dishwasher.

Water remaining in the tub may flow downward due to gravity. In addition, the dry air supplier may be disposed below the tub. Accordingly, liquid water (i.e., condensed water) may flow into the dry air supplier from the tub.

The water introduced into the dry air supplier could flow to a bottom of abase in which the dry air supplier is disposed through a hole formed in a lower surface of the dry air supplier.

If water excessively accumulates on the bottom of the base, water leakage might occur on the external floor of the location where the dishwasher is installed through a gap in the bottom of the base.

If such water leakage occurs, the operation of the dishwasher may be stopped and the dishwasher is inspected to find and stop the cause of the water leak.

Even if a controller provided in the dishwasher fails to detect water leak, the leakage amount might increase enough to cause a malfunction or great inconvenience to a users of the dishwasher.

Therefore, to suppress such a risk, the controller of the dishwasher needs to quickly detect presence of water leakage in the base.

SUMMARY

One objective of the present disclosure is to provide a control method of a dishwasher including a dry air supplier that may efficiently dry water remaining on a dish when using the dishwasher.

A further object of the present disclosure is to provide a control method of a dishwasher with a structure that may easily mount and demount a dry air supplier in and from the dishwasher.

A still further object of the present disclosure is to provide a control method of a dishwasher with a structure configured to quickly detect water leakage that might occur due to a condensate flowing down to a bottom of a base after introduced from a dry air supplier.

A still further object of the present disclosure is to provide a control method of a dishwasher with a structure configured to prevent a malfunction of a water leakage detecting device caused by water leaking through a gap between a cover and a base, not flowing toward a water leakage detecting device, if water leakage occurs on a cover for replacing a dry air supplier.

A still further object of the present disclosure is to provide a control method of a dishwasher with a structure configured to directing water leaked from a dry air supplier to a water leakage detecting device, even when a base protrudes upward in order to install parts such as a hose or a cable placed on a bottom of the base.

Aspects according to the present disclosure are not limited to the above ones, and other aspects and advantages that are not mentioned above can be clearly understood from the following description and can be more clearly understood from the embodiments set forth herein.

In a dishwasher according to an embodiment, a cover may be coupled to a base to allow some area to be disposed inside the base through an opening formed in a bottom surface of the base, and a dry air supplier may be mounted to the cover.

The cover may be detachably coupled to the base and configured to close the opening in a state of being coupled to the base.

The opening may be formed in an area of the bottom surface of the base where the cover and the dry air supplier are disposed. The cover and the dry air supplier may be introduced into the base or taken out from the base through the opening.

At this time, some are of the mounting may be fitted to the bottom surface of the base adjacent to the opening. Due to this structure, when it is coupled to the base, the cover may close the opening.

In addition, in a state where the cover is decoupled from the base, the opening may be open and so that the dry air supplier may be taken out from the base.

When the cover is separated from the base, the opening may be open and a worker can take out the dry air supplier mounted in the base. To check or repair the dry air supplier, the worker needs to stop the operation of the dishwasher and separate the dry air supplier from the base.

In an embodiment, when taking out the dishwasher by separating the dry air supplier from the base, the worker may take out the dry air supplier from the inside of the base through the opening formed in the bottom surface of the base by decoupling the cover.

The base may include a water leak detection device and a first inducing portion. The water leak detection device may be disposed on the base and configured to detect water leaking into the base. The water leak detection device may be disposed at a position lower than the other area of the base to flow the water introduced into the base to the water leak detection device by gravity.

The first inducing portion may be protruding toward the body, and configured to induce the water discharged from an upper surface of the body to flow into the water leak detection device. The first inducing portion may be in communication with the body. Accordingly, the water discharged from the housing of the dry air supplier may fall down to an upper surface of the body of the cover and re-flow along the first inducing portion.

The first inducing portion may have an inlet in communication with the second inducing portion of the cover and an outlet directed to the water leak detection device. Accordingly, the water introduced into the first inducing portion may have a flow path induced by the first inducing portion to be discharged to the water leak detection device.

The cover may include a second inducing portion protruding from the body and disposed at a position to the first inducing portion, and configured to induce the water falling down to an upper surface of the body after discharged from the dry air supplier to be directed to the first inducing portion.

A dishwasher according to an embodiment may include a tub in which dishes are stored; a base disposed below the tub; a dry air supplier configured to spray air to the tub; and a cover to expose the dry air supplier outside through an opening formed in a bottom surface of the base and configured to close the opening by being coupled to the base.

The cover may be detachably coupled to the base and configured to close the opening in a state of being coupled to the base.

In a state where the cover is decoupled from the base, the opening may be open and so that the dry air supplier may be taken out from the base.

The dry air supplier may include a housing in which an air flow path is formed; and a leg protruding from the housing. The cover may include a body having an upper surface on which the dry air supplier is seated; and a recess recessed from the body, the recess on which the leg is seated.

The dry air supplier may include a ventilation fan connected to the housing and configured to forcibly blow the air introduced into the dry air supplier; a heating part disposed inside the housing and configured to heat the air forcibly blown by the ventilation fan; an air discharge part connected to the housing to communicate with an air outlet of the housing and configured to guide flow of air discharged from the tub; and a divider connected to an end of the air discharge part and exposed to the tub, and configured to discharge forcibly flowing air to the tub.

The base may include a water leak detection device disposed in a lower area of the base and configured to detect water leaking into the base; and a first inducing portion configured to induce the water discharged from an upper surface of the body to flow into the water leak detection device.

The cover may include a second inducing portion protruding from the body and disposed at a position to the first inducing portion, and configured to induce the water falling down to an upper surface of the body after discharged from the dry air supplier to be directed to the first inducing portion.

The height of an upper surface of the second inducing portion may be equal to that of a bottom surface of the water leak detection device or greater than that of the bottom surface of the water leak detection device.

The first inducing portion and the second inducing portion may partially overlap in a vertical direction, and an upper surface of the second inducing portion may be disposed at a position higher than an upper surface of the first inducing portion.

The inducing portion may include a first region in communication with the second inducing portion and configured to receive water from the cover; and a second region bent from the first region and configured that an end is directed toward the water leak detection device.

The base may include a first rib protruding from each of both sides of the first inducing portion. The cover may include a second rib protruding from each of both sides of the second inducing portion, and at least some area of the second rib overlaps with the first rib.

The cover may include a third rib protruding from an upper surface of the cover and having one end connected to the second rib.

The base may include an upward protrusion formed by protruding some area of the bottom surface upward, and the first inducing portion and the first rib are formed to surround some area of an upper surface of the upward protrusion.

The cover may include a hook provided at least one in a lateral surface and coupled to the base by shape fitting; and a coupling portion provided in a lateral surface, spaced apart from the hook, and coupled to base by a coupling tool.

The cover may include a first support protrusion protruding from an upper surface of the body, the first support protrusion on which the dry air supplier is seated to be supported.

The cover may include a guide protrusion protruding from a lateral surface and fitted to the base, and configured to guide a position at which the cover is coupled to the base. The base may include a guide groove formed at a position to the guide protrusion, the guide groove to which the guide protrusion is fitted.

The cover may include a second support protrusion protruding from an upper surface of the body, spaced apart from the first support protrusion, and configured to support a lateral surface of the dry air supplier.

The second inducing portion may extend from the body and has an inclination with respect to the body.

The first region is formed to have an inclination with respect to the body, and the second inducing portion and the first region may have a shape that is inclined so that an outlet is directed downward with respect to a flow direction of water.

In the dishwasher according to the present disclosure, the dry air supplier that is easily detachable with respect to the base may be provided and the dry air supplier may be in communication with a tub. Accordingly, the dry air supplier may supply dry air to the tub in order to dry water remaining in the tub during a drying process, thereby facilitating convenient dishwashing and reducing the drying time.

Furthermore, in the dishwasher according to the present disclosure, when separating the dry air supplier from the base to take out from the dishwasher, a worker may separate the cover and then take out the dry air supplier from the inside of the base through the opening formed in the bottom surface of the base. Accordingly, the worker can easily take out the dry air supplier from the inside of the base when checking or repairing the dry air supplier.

Still further, in the dishwasher according to the present disclosure, the water discharged from the housing may smoothly flow to the water leak detection device along the second inducing portion provided in the base from the second inducing portion of the cover. Accordingly, when water is flowing in and out from the housing, the discharged water may immediately flow into the water leak detection device so that the controller may immediately determine that water is introduced into the housing based on the water leak detection device.

Accordingly, when noticing the occurrence of the water leak on the bottom surface of the base after water flowing into the dry air supply device, a user may stop the operation of the dishwasher and take needed actions to repair the dry air supplier and cut off other water leaks.

Specific effects are described along with the above-described effects in the section of Detailed Description.

DETAILED DESCRIPTION

Figure 1:
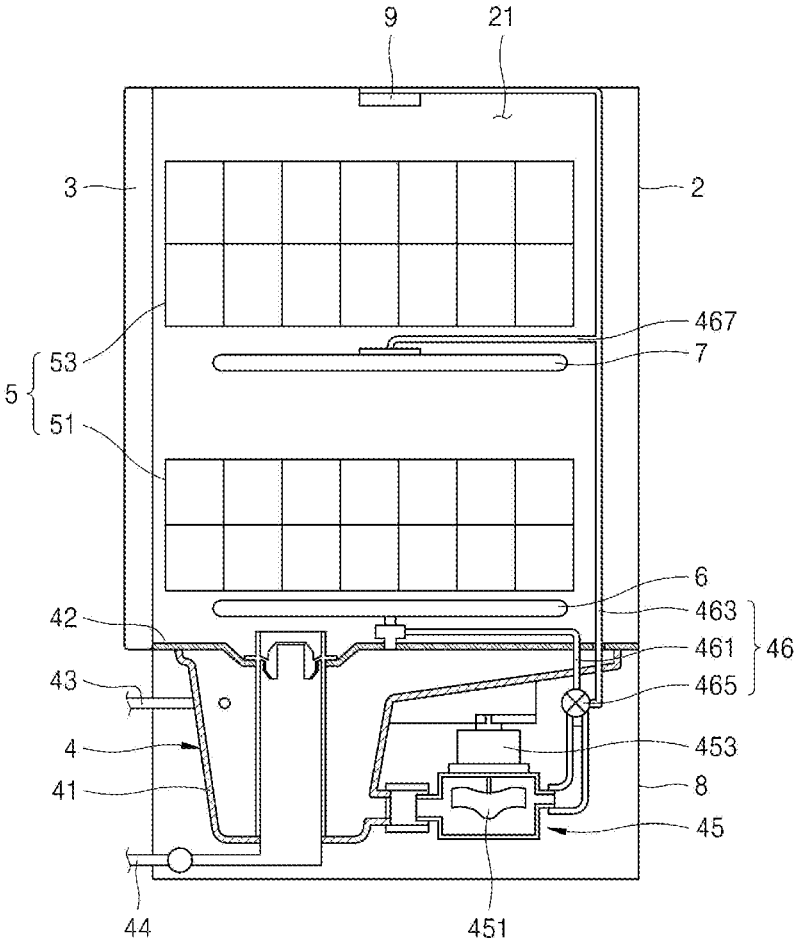
FIG. 1 is a sectional view schematically showing a dishwasher according to an embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Throughout the present disclosure, "up-down direction (or a vertical direction)" means an up-and-down direction of a dishwasher that is installed for daily use. "Left-right direction (or horizontal direction)" means a direction orthogonal to the up-down direction, and "front-back direction means a direction orthogonal to both the up-down direction and the left-right direction. "Both side directions" or "lateral directions" have the same meaning as the left-right direction. These terms may be used interchangeably herein.

A Cartesian coordinate system can be used in drawings. In the Cartesian coordinate system, a z-axis direction means an up-down direction and an x-axis direction means a front-back direction. A y-axis direction means a left-right direction.

FIG. 1 is a sectional view schematically showing a dishwasher according to an embodiment.

Referring to FIG. 1, the dishwasher may include a housing defining an exterior design, a tub 2 defining a washing space 21 inside the housing and configured to receive dishes as washing targets, a door 3 rotatably coupled to a base 8 and configured to selectively open and close the washing space 21, a sump 4 provided in a lower area of the tub 2 and configured to store wash water, a storage part 5 provided inside the tub 2 and configured to store the washing targets, and a spray arm 6, 7, and 9 configured to spray wash water toward the washing targets stored in the storage part 5. In this instance, dishes may include bowls, plates, spoons, chopsticks or other cooking utensils, for example.

The tub 2 may define the washing space 21 and receive dishes. The storage part 5 and the spray arm 6, 7, and 9 may be provided inside the washing space 21. The tub has one open surface and the open surface may be closable by the door 3.

The door 3 may be rotatably coupled to the housing and configured to selectively open and close the washing space. For example, a lower portion of the door 3 may be hingedly coupled to the housing.

In this instance, the door 3 may be rotatably on the hinge to open and close the tub 2. When the door 3 is opened, the storage part 5 may be drawn to the outside of the dishwasher and the drawn storage part 5 may be supported by the door 3.

The sump 4 may include a storage portion 41 configured to store wash water, a sump cover 42 configured to partition off the storage portion 41 from the tub 2, a water supply portion 43 configured to supply wash water to the storage portion 41 from the outside, a water discharge portion 44 configured to discharge the wash water from the storage portion 41, and a water supply pump 45 and a water supply path 46 that are configured to supply the wash water stored in the storage portion 41 to the spray arm 6, 7 and 9.

The sump cover 42 may be disposed on atop of the sump 4 and configured to separate the sump 4 from the tub 2. In addition, the sump cover 42 may include a plurality of water collection holes configured to recollect the wash water sprayed to the washing space 21 through the spray arm 6, 7 and 9.

Specifically, the wash water sprayed from the spray arm 6, 7 and 9 may fall down to the bottom of the washing space 21 and pass through the sump cover 42 to be recollected in the storage portion 41 of the sump 4.

The water supply pump 45 may be provided in a side area or a lower area of the storage portion 41 and configured to supply wash water to the spray arm 6, 7 and 9.

The water supply pump 45 may have one end connected to the storage portion 41 and the other end connected to the water supply path 46. An impeller 451 and a motor 453 may be provided inside the water supply pump 45. When electricity is supplied to the motor 453, the impeller 451 may be rotated and the wash water of the storage portion 41 may be supplied to the spray arm 6, 7 and 9 through the water supply path 46.

The water supply path 46 may be configured to selectively supply the wash water flowing in from the water supply pump 45 to the spray arm 6, 7 and 9.

The water supply path 46 may include a first water supply path 461 connected to a lower spray arm 6, a second water supply path 463 connected to an upper spray arm 7 and a top nozzle 9, and a water supply path switching valve 465 configured to selectively open and close the water supply paths 461 and 467. In this instance, the water supply path switching valve 465 may be controlled to sequentially or simultaneously open the water supply paths 461 and 463.

At least one storage part 5 may be provided in the washing space 21 to store dishes. Two storage parts 5 are provided in the dishwasher shown in FIG. 1, but the present disclosure is not limited thereto.

As one example, the dishwasher may include only one storage part or three or more storage parts. In this instance, the number of the spray arms may be variable based on the number of the storage parts.

The storage part 5 may include a lower rack 51 and an upper rack 52 to store dishes. The lower rack 51 may be disposed in the washing space 21 and dishes may be stored in the lower rack 51. The upper rack 53 may be disposed above the lower rack 53 and dishes may be stored in the upper rack 53. Here, a top rack may be disposed between a space between a top of the upper rack 53 and a top nozzle 9, and dishes may be stored in the top rack.

The lower rack 51 may be disposed above the sump 4 and the upper rack 53 may be positioned higher than the lower rack 51. The lower rack 51, the upper rack 52 and the top rack may be movable to the outside through the open surface of the tub 2.

To this end, a rail type holder may be provided on an inner surface of the tub 2. Wheels may be provided on a lower surface of the rack 51 and 53. The user may store dishes or take out the washed dishes by withdrawing the storage part 5 to the outside.

The spray arm may be provided inside the tub 2 and configured to spray wash water toward the dishes stored in the storage part 5. The spray arm may include a lower spray arm 6, an upper spray arm 7 and a top nozzle 9.

The lower spray arm 6 may be rotatably provided below the lower rack 51 and configured to spray to the dishes. The upper spray arm 7 may be rotatably provided between the upper spray arm 7 and the lower rack 51 and configured to spray wash water to the dishes.

The lower spray arm 6 may be rotatably coupled to a top of the sump cover 42 and configured to spray wash water toward the dishes stored in the lower rack 51. The upper spray arm 7 may be disposed above the lower spray arm 6 and configured to spray wash water toward the dishes stored in the upper rack 53. The top nozzle 9 may be provided in an upper are of the washing space 21 and configured to spray wash water to the lower rack 51 and the upper rack 53.

As described above, the first water supply path 461 may be configured to supply wash water to the lower spray arm 6 and the second water supply path 463 may be configured to supply wash water to the upper spray arm 7 and the top nozzle 9.

Referring to FIG. 1, the dishwasher may include a base 8. The base 8 may be disposed underneath the tub 2 and the tub 2 may be mounted to the base. The base 8 may provide a space in which the sump 4 is disposed, and also a space in which the pump, the dry air supplier 100 and other various mechanisms are disposed.

Accordingly, the base 8 may have an outer wall to support the entire dishwasher and form a space to accommodate various devices.

Figure 2:
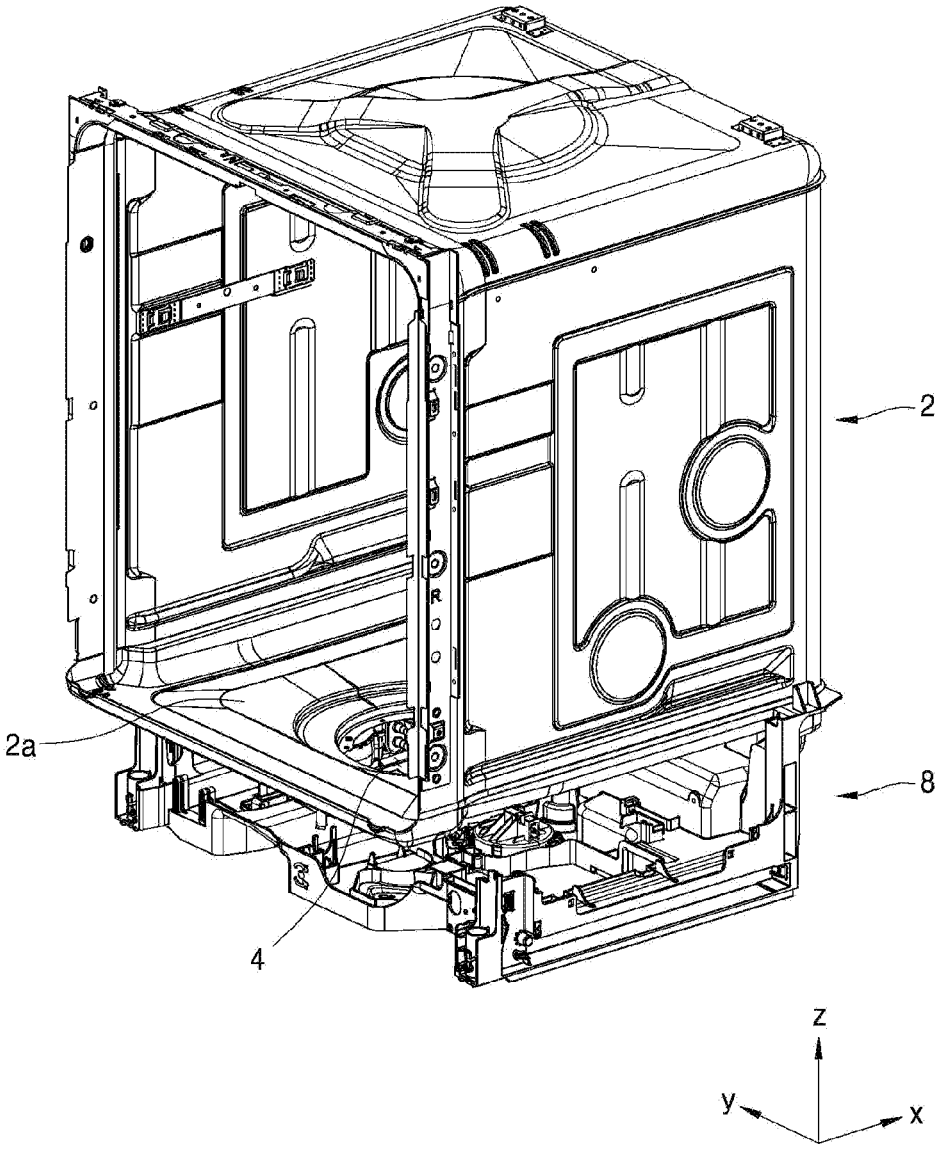
FIG. 2 is a perspective view showing a tub and abase that are provided in a dishwasher according to an embodiment.
Figure 3:
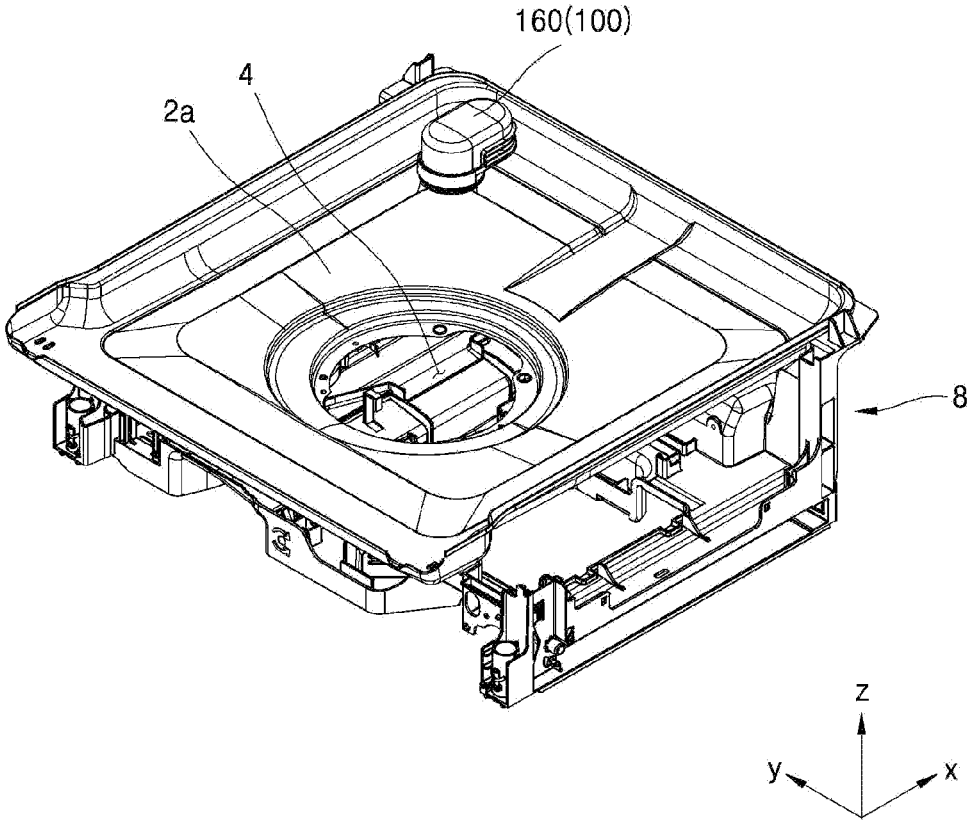
FIG. 3 is a view showing a coupling state between a base and a bottom plate of a tub.
Figure 4:
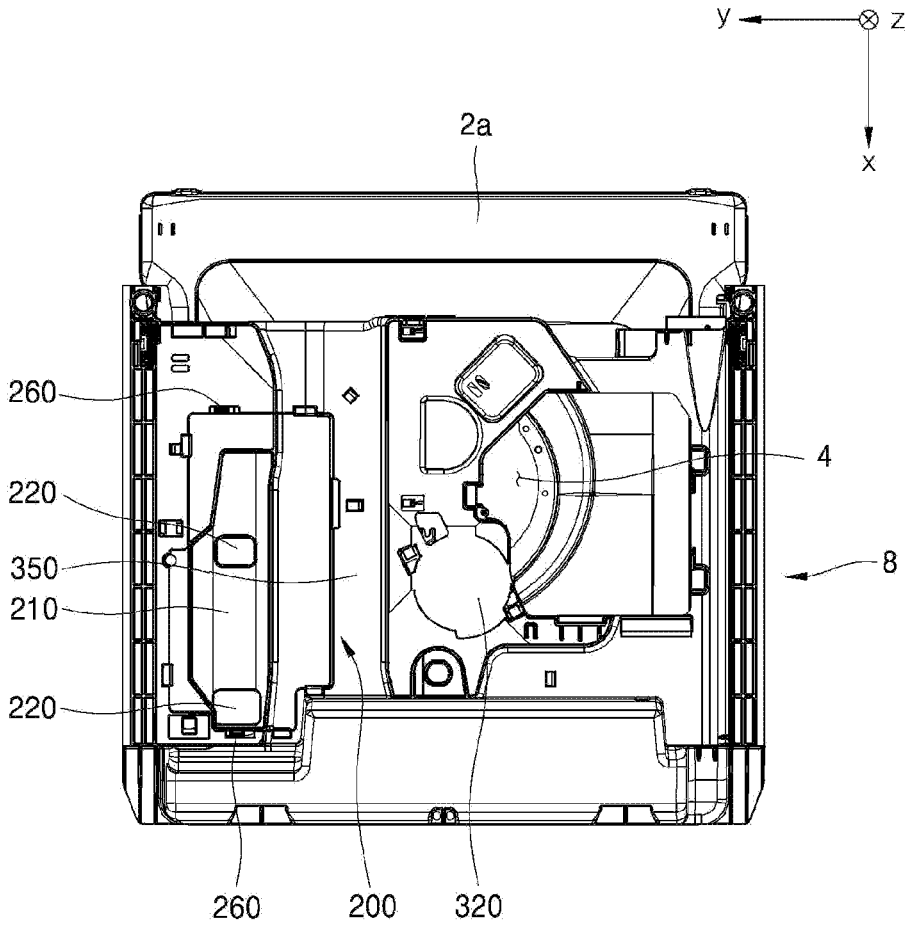
FIG. 4 is a bottom view showing a base according to an embodiment.

FIG. 2 is a perspective view showing a tub 2 and a base 8 that are provided in a dishwasher according to an embodiment. FIG. 3 is a view showing a coupling state between a base 8 and a bottom plate of a tub 2. FIG. 4 is a bottom view showing a base 8 according to an embodiment.

Figure 5:
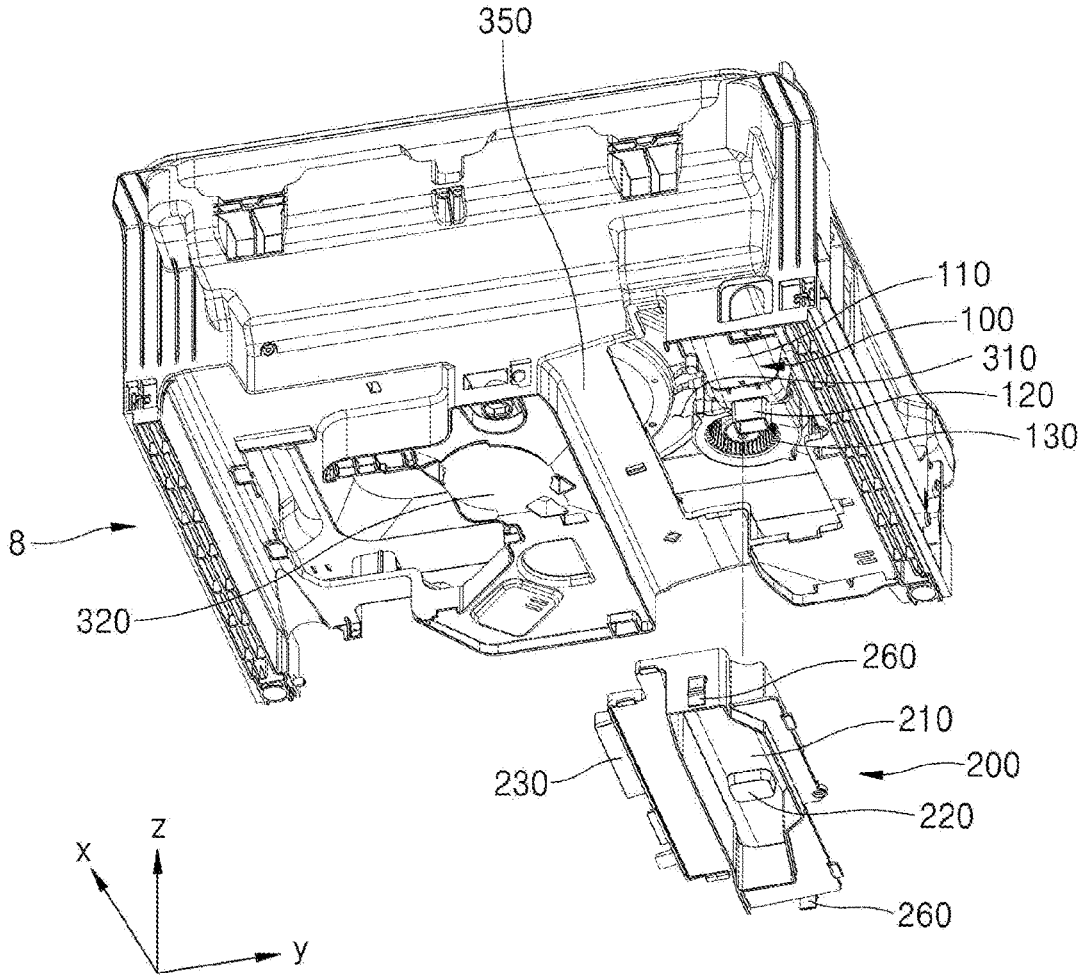
FIG. 5 is an exploded perspective view of a cover cut away from a base.
Figure 6:
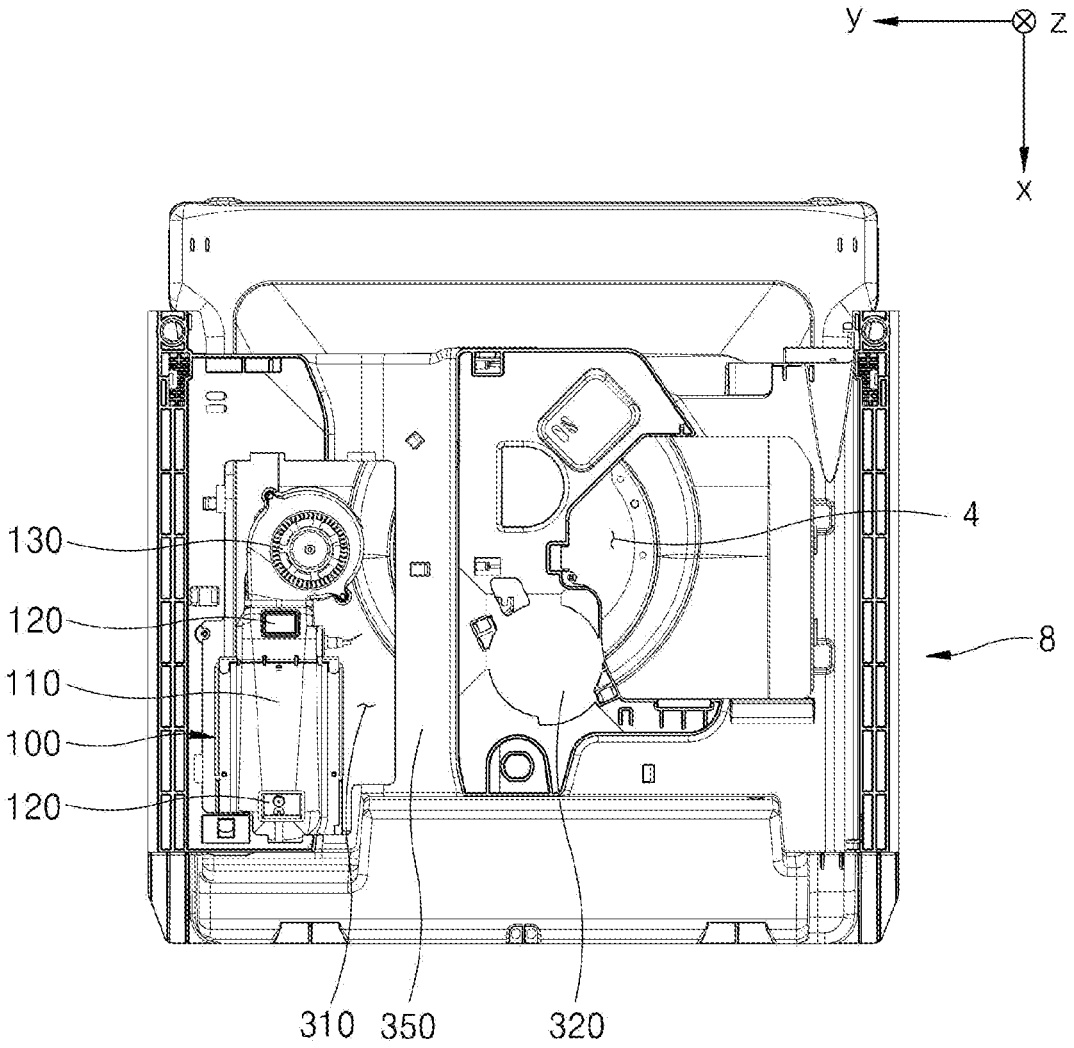
FIG. 6 is a bottom view showing a state where a cover is omitted from a base.
Figure 7:
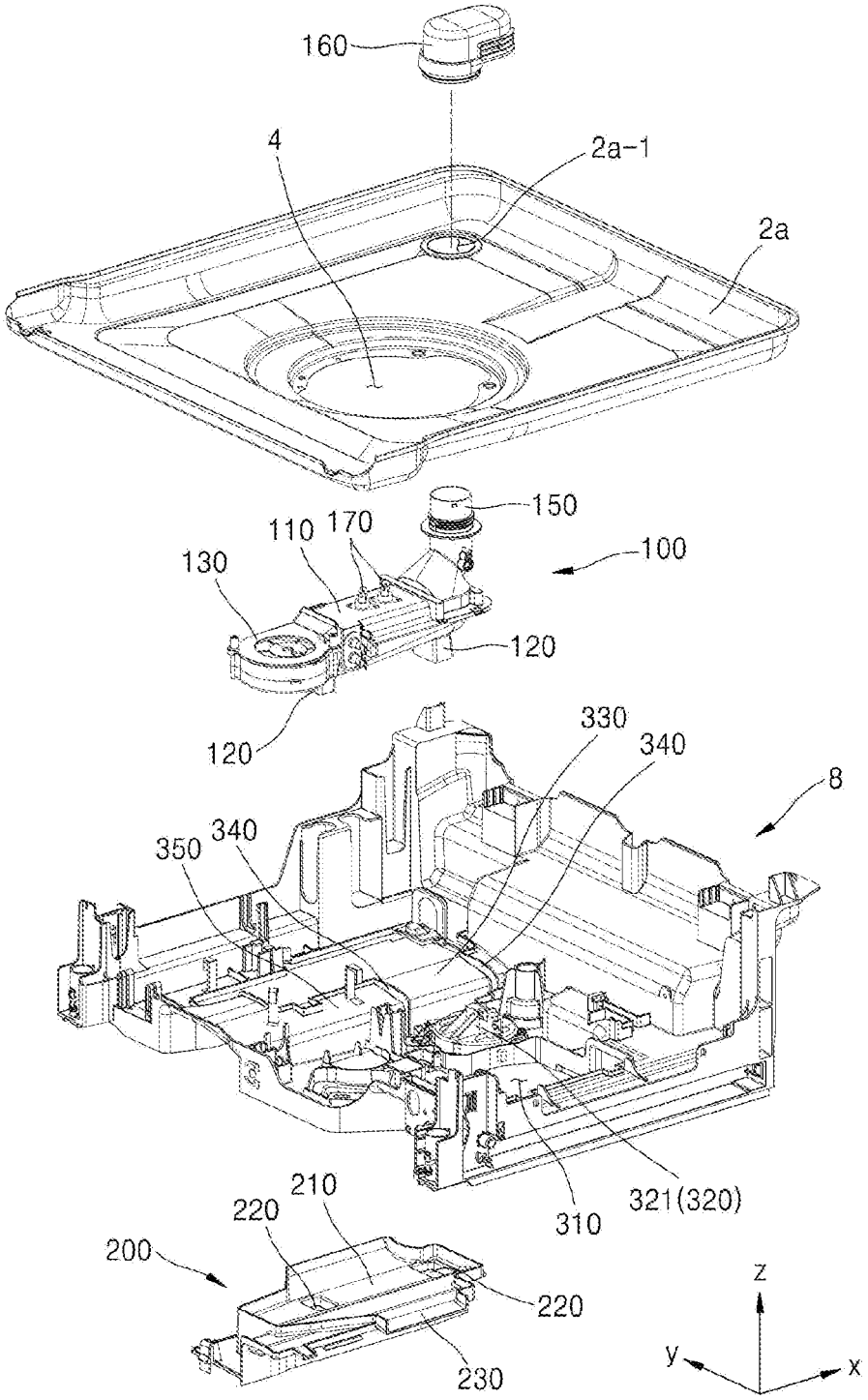
FIG. 7 is an exploded perspective view showing a base and parts that are mounted to the base.
Figure 8:
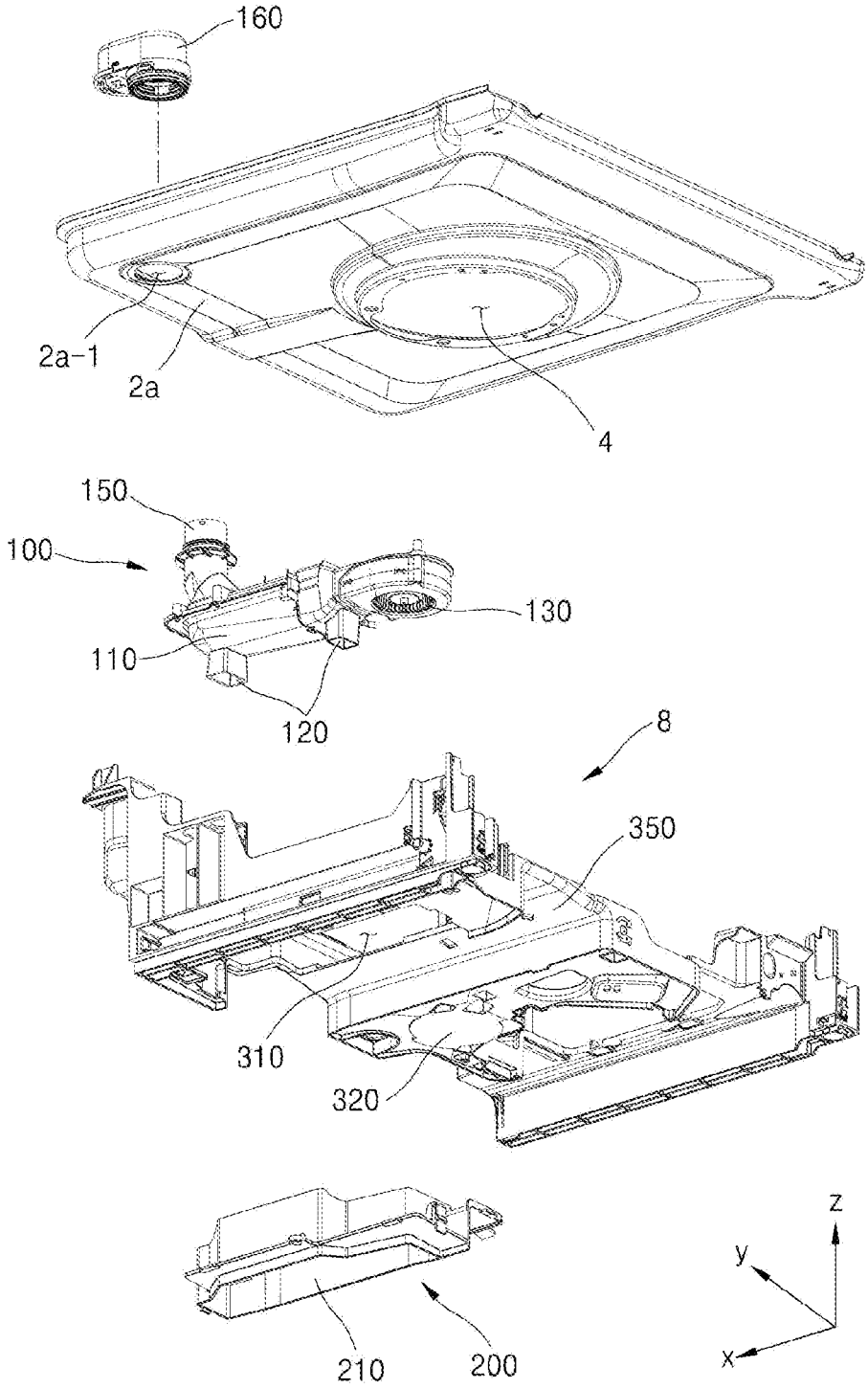
FIG. 8 is a view of FIG. 7, viewed from a different direction.

FIG. 5 is an exploded perspective view of a cover 200 cut away from a base 8. FIG. 6 is a bottom view showing a state where a cover 200 is omitted from a base 8. FIG. 7 is an exploded perspective view showing a base 8 and parts that are mounted to the base 8. FIG. 8 is a view of FIG. 7, viewed from a different direction.

The base 8 may be disposed underneath the tub 2, and the tub 2 may be mounted to the base. A door may be rotatably coupled to the base 8, and configured to open and close the washing space. Accordingly, the door may be disposed in front of the base 8 and hinge coupling portions for hingedly coupling the door to the base may be provided in both front side areas of the base 8.

The dishwasher according to an embodiment may include a dry air supplier 100 and a cover 200 that are provided in the base 8. The dry air supplier 100 may be disposed in an area of the base 8 that does not overlap with the sump 4. The cover 200 may be provided to mount the dry air supplier 100, and may be disposed at a position of the base 8 corresponding to the dry air supplier 100.

The dry air supplier 100 may be configured to spray air to the tub 2. The dry air supplier 100 may be disposed in the base 8 and configured to spray heated air to the tub 2. The dry air supplier 100 may be in communication with the tub 2, and configured to spray air to the tub. The dry air supplier 100 may dry the dishes stored in the tub 2 by spraying dry air, which is a heated air, into the tub 2.

The dry air supplier 100 may spray cold air that is not-heated air flow or hot air that is heated-air flow. The dry air supplier 100 may spray cold air or hot air into the tub 2 by controlling a heating part 140 provided therein.

In a state of not operating the heating part 140, the dry air supplier 100 may spray cool air to the tub 2. When operating the heating part 140, the dry air supplier 100 may spray hot air to the tub 2. Hereinafter, unless otherwise specified, the dry air supplier 100 configured to spray hot air will be described. In addition, unless otherwise specified, dry air means hot air.

Referring to FIGS. 7 and 8, the dry air supplier 100 may include a housing 110, a leg 120, a ventilation fan 130, a heating part 140, an air discharge part 150 and a divider 160

The housing 110 may define an overall exterior of the dry air supplier 100 and a passage of air flow may be formed in the housing 110. The ventilation fan 130 may be mounted in the housing 110 and a predetermined area of the heating part 140 may be disposed inside the housing 1210.

The leg 120 may protrude from the housing 110, and may be coupled to the cover 200. Accordingly, the dry air supplier 100 may be mounted to the cover 200 to be disposed in the base 8.

The ventilation fan 130 may be connected to the housing 110 and configured to forcibly flow the air introduced into the dry air supplier 100. The ventilation fan 130 may be controlled by a controller provided in the dishwasher to be rotatable.

The ventilation fan 130 may include a fan configured to forcibly flow air, and a bracket to which the fan is rotatably coupled, with a structure corresponding to a shape of the fan.

The ventilation fan 130 may include an air inlet for drawing outside air. The air inlet may be formed to receive air in a direction parallel to a rotation axis of the fan. The air inlet may be formed by making a hole in the bracket of the ventilation fan 130.

The heating part 140 may have at least some area mounted in the housing 110, and may be configured to heat the air forcibly flowing by the ventilation fan 130. The area of the heating part 140 exposed to the outside of the housing 110 may be for connection to a power source.

The heating part 140 may be mounted inside the housing 110 and the air forcibly flowing by the ventilation fan be heated by the heating part 140 to become dry air.

For example, the heating part 140 may be an electric resistance type heating coil (i.e., a sheath heater) but is not limited thereto. Accordingly, one end of the heating part 140 may be partially exposed to the outside of the housing 110 to be electrically connected to the power source.

The air discharge part 150 may be may be coupled to the housing 110 to be in communication with an air outlet of the housing 110 and configured to guide the flow of air discharged to the tub 2. The air discharge part 150 may have a hollow for air flow and serve as a duct accordingly.

An air discharge hole is formed at one end of the air discharge part 150 to discharge air. The air discharge hole may be configured to communicate with the inside of the tub 2. Accordingly, the air discharged through the air discharge hole may flow into the tub to be dispersed.

A through-hole **2*a*-1 may be formed on a bottom plate 2*a* of the tub 2 at a position corresponding to an upper area of the air discharge part 150. An upper area of the air discharge part 150 may be inserted in the through-hole 2*a*-1 to supply dry air to the tub 2 through the air discharge part 150 from the dry air supplier 100 disposed on the base 8**.

The divider 160 may be coupled to an end of the air discharge part 150 and exposed to the tub, and configured to discharge the forcibly flowing air to the tub 2. The divider 160 may be coupled to the end of the air discharge part 150 and disposed on the bottom plate **2*a* of the tub 2**.

The air forcibly blown inside the dry air supplier 100 by the ventilation fan 130 may flow in the following order. Once the ventilation fan 130 is put into operation, air may be introduced into the ventilation fan 130 through the air inlet of the ventilation fan 130.

The air after passing through the ventilation fan 130 may be drawn into the housing 110 that is in communication with the ventilation fan 130, and may be heated by the heating part 140 disposed in the housing 110 to be discharged from the housing 110 and flow into the air discharge part 150. The air discharged from the air outlet of the air discharge part 150 may flow into the tub 2 through the divider 160, thereby supplying dry air to the tub 2.

The dry air supplier 100 may further include a fuse device 170. The fuse device 170 may be mounted to the housing 110 and configured to detect presence of overheating of the heating part 140. When the temperature of the heating part 140 increases above a preset critical temperature, the fuse device 170 may serve as a kind of a thermostat configured to disconnect an internal circuit.

At this time, when an internal circuit of the fuse device 170 is disconnected, the operation of the heating part 140 in which overheating occurs may be stopped by immediately cutting off the electricity supplied to the heating part 140.

In an embodiment, the dry air supplier 100 that is easily mountable and demountable to and from the base 8 may be provided. The dry air supplier 100 may be in communication with the tub 2. Accordingly, in order to dry water remaining in the tub 2 of the dishwasher during the drying process, the dry air supplier 100 may supply dry air to the tub 2 so that dishwashing can be convenience and the drying time may be reduced.

The cover 200 may be mounted to the base 8 to dispose some area thereof inside the base 8 through an opening formed in a bottom of the base 8, and the dry air supplier 100 may be mounted to the cover 200.

The cover 200 may be configured to expose the dry air supplier 100 through the opening formed in the bottom of the base 8 and coupled to the base 8, to open and close the opening 310.

The cover 200 may be detachably coupled to the base 8. In a state of being coupled to the base 8, the cover 200 may be configured to open and close the opening 310.

The opening 310 may be formed in an area of the base bottom where the cover 200 and the dry air supplier 100 are disposed. The cover 200 and the dry air supplier 100 may be moved inward and outward with respect to the base 8 through the opening 310.

At this time, some area of the cover 200 may be fitted to the bottom area of the base 8 that is adjacent to the opening 310. Due t to this structure, when it is mounted to the base 8, the cover 200 may open and close the opening 310.

In a state where the a cover 200 is demounted from the base 8, the opening 310 may be open and the dry air supplier 100 may be moved outward from the base 8.

When the cover 200 is demounted from the base 8, the opening 310 may be open so that the worker may take the dry air supplier 100 mounted in the base 8. To check and repair the dry air supplier 100, it is necessary to stop the operation of the dishwasher and separate the dry air supplier 100 from the base 8.

In an embodiment, when separating and discharging the dry air supplier 100 from the base 8, the worker can take out the dry air supplier 100 from the base 8 through the opening 310 formed in the bottom of the base 8 by detaching the cover 200 to separate and discharge the dry air supplier 100 from the base 8.

Accordingly, in case of checking or repairing the dry air supplier 100, the worker may easily take out the dry air supplier 100 from the inside of the base 8.

The cover 200 may include a body 210 and a recess 220. The body 210 may receive the dry air supplier 100 on an upper surface thereof. The recess 220 may be formed by recessing the body 210 to receive the leg 120.

The recess 220 may be recessed in a shape corresponding to the leg 120 protruding from the housing 110 of the dry air supplier 100. When the leg 120 is seated on the recess 220, the dry air supplier 100 may be stably mounted to the cover 200.

Figure 9:
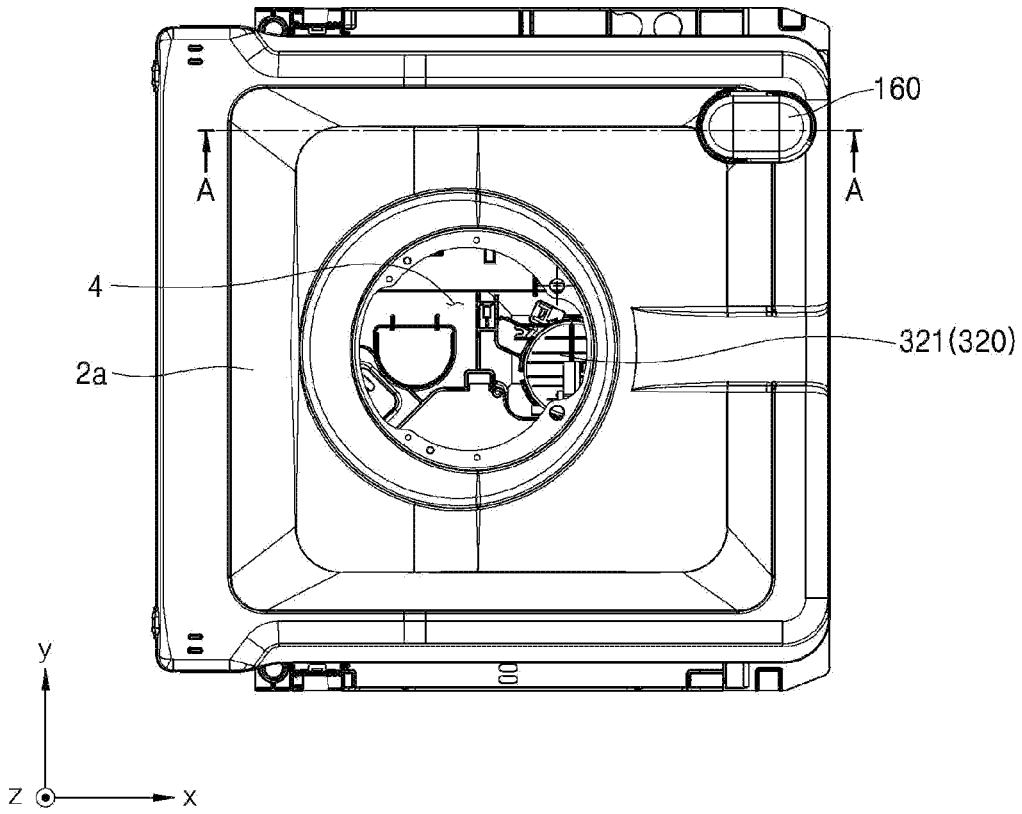
FIG. 9 is a plane view of a base according to an embodiment.
Figure 10A:
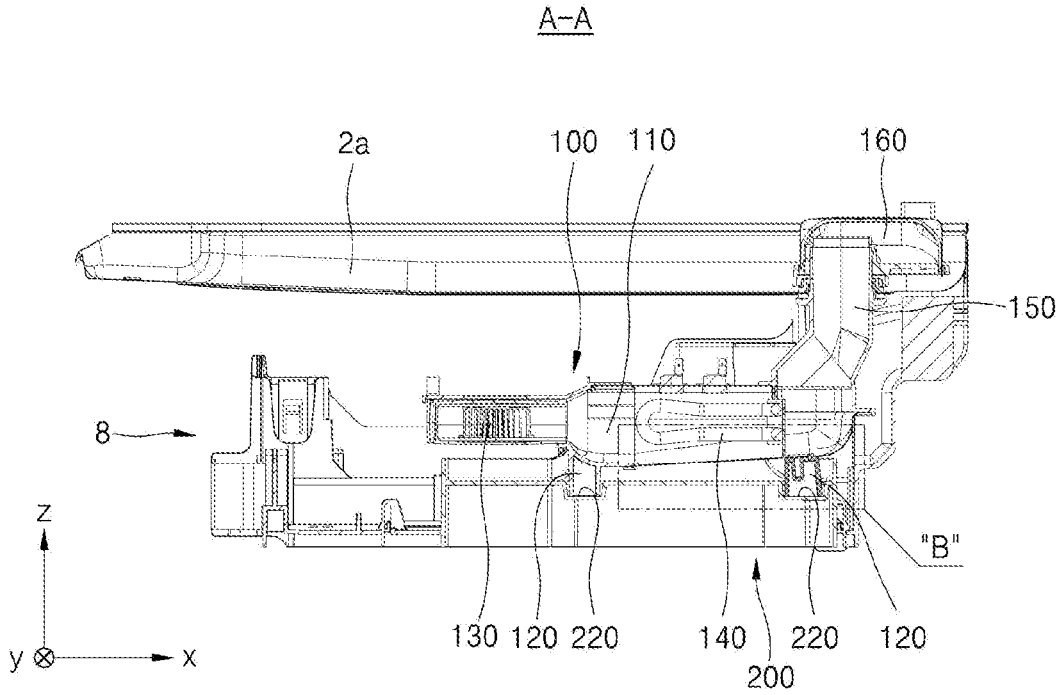
FIG. 10A is a sectional view cut away along AA shown in FIG. 9.
Figure 10B:
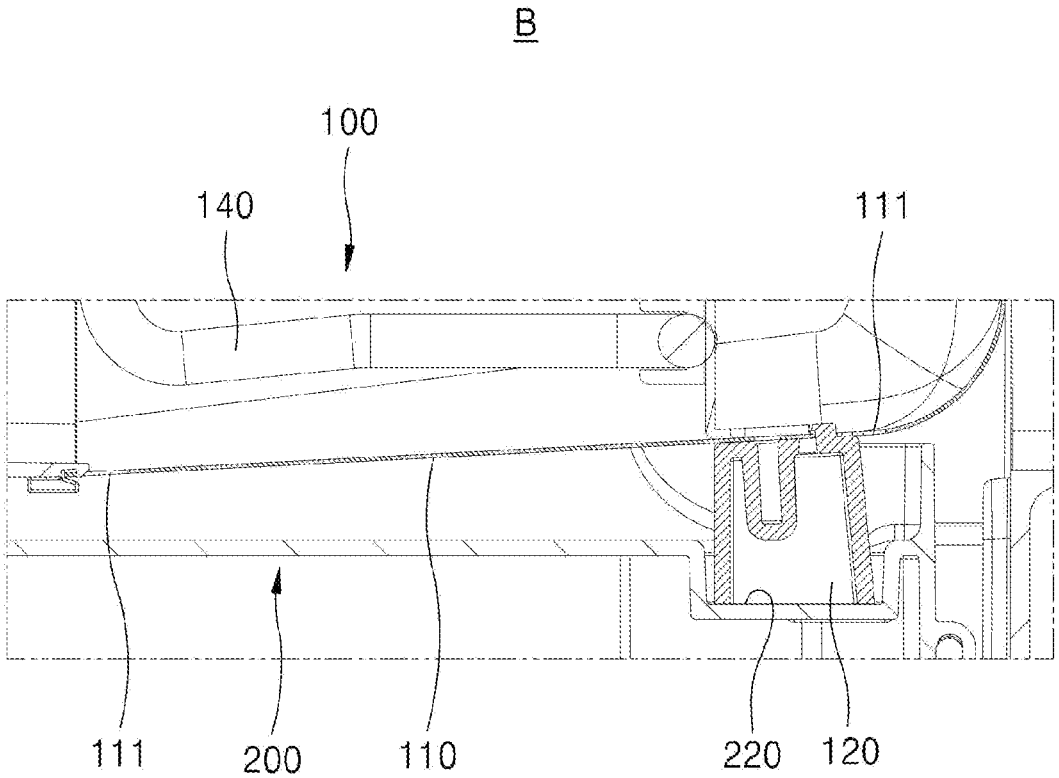
FIG. 10B is an enlarged sectional view of 'B' shown in FIG. 10A.

FIG. 9 is a plane view of abase 8 according to an embodiment. FIG. 10A is a sectional view cut away along AA shown in FIG. 9. FIG. 10B is an enlarged sectional view of 'B' shown in FIG. 10A.

Figure 11:
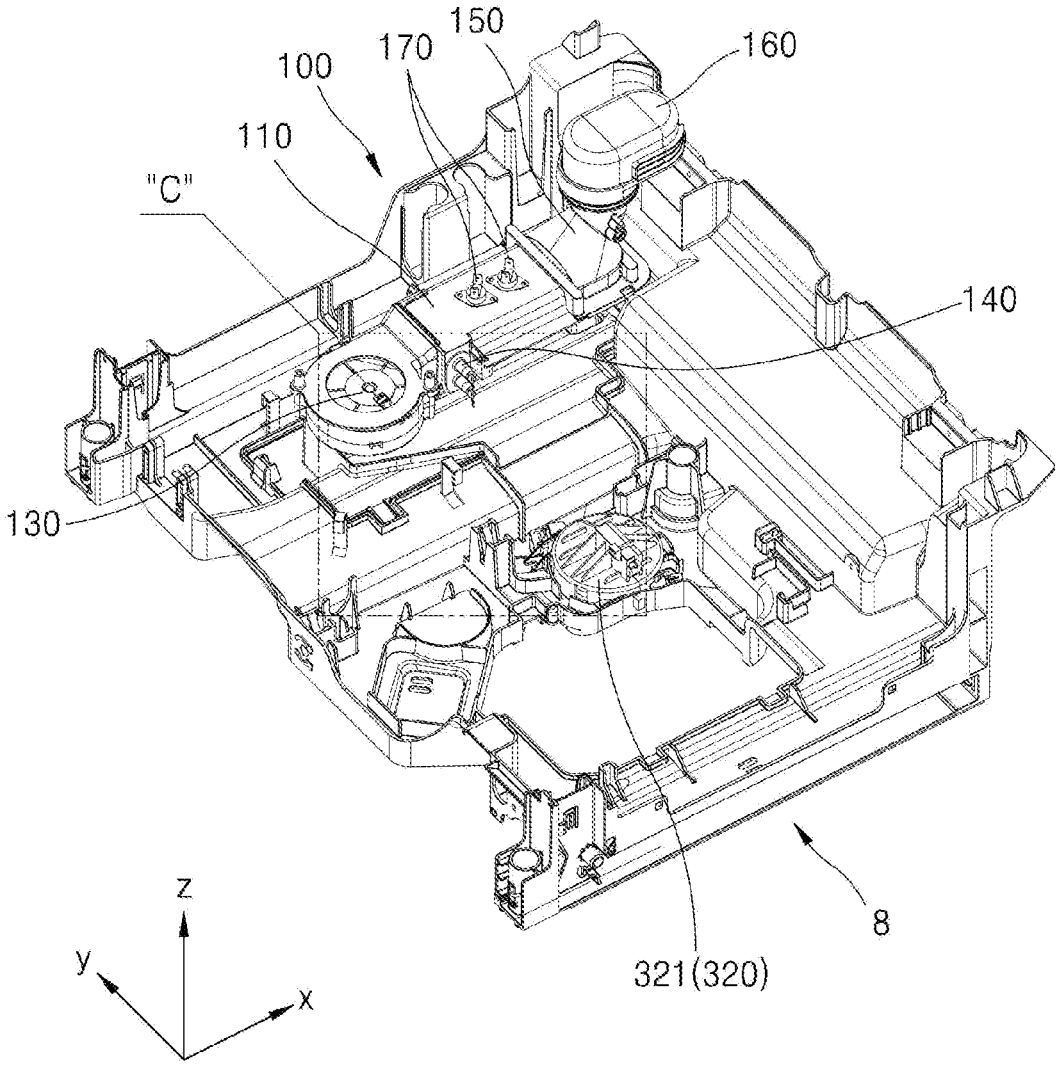
FIG. 11 is a perspective view showing a base, while omitting a bottom plate of a tub.
Figure 12:
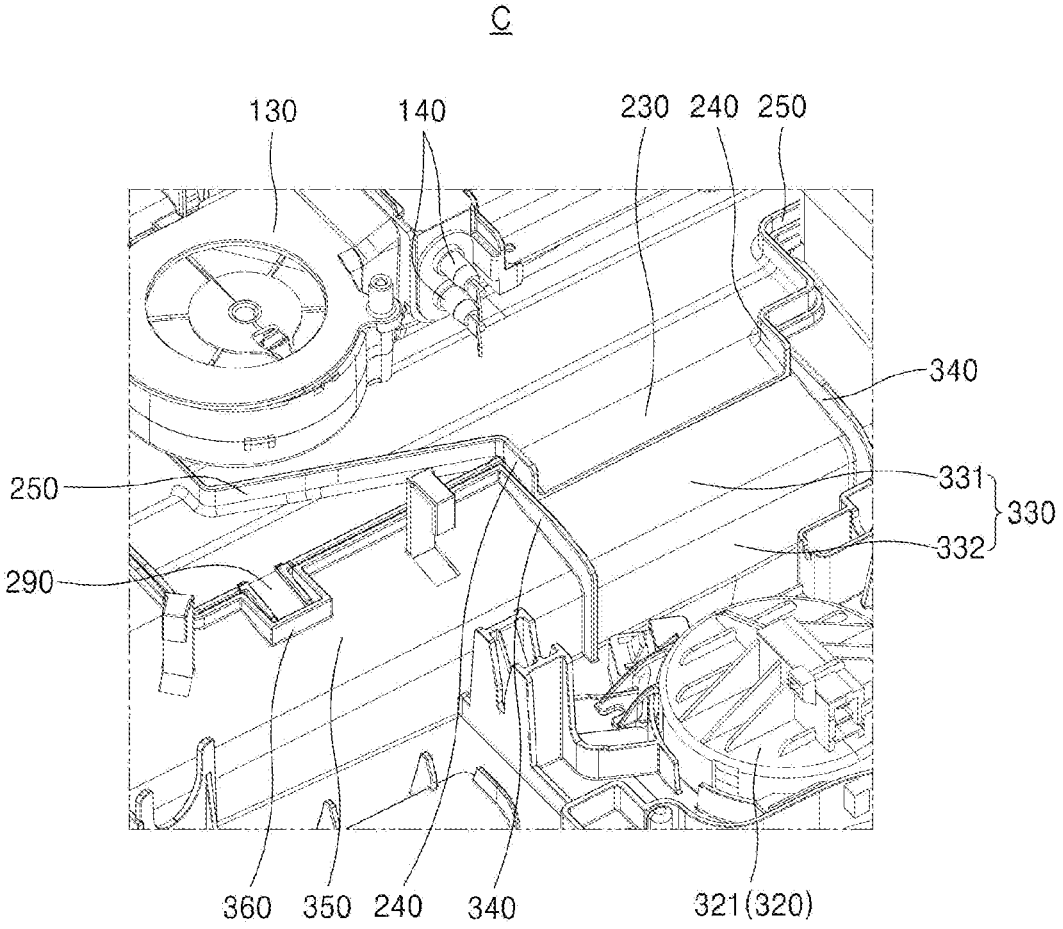
FIG. 12 is an enlarged view of 'C' shown in FIG. 11.

FIG. 11 is a perspective view showing a base 8, while omitting a bottom plate 2*a* of a tub 2. FIG. 12 is an enlarged view of 'C' shown in FIG. 11.

Wash water may be supplied to the tub 2 of the dishwasher and the wash water may be stored in the sump 4. However, water leakage could occur in the tub 2 or the sump 4.

Related to the embodiment, water remaining in the tub 2 may flow downward due to gravity. In addition, the dry air supplier 100 may be disposed in the base 8 positioned below the tub 2. Accordingly, liquid water (i.e., a condensate) might flow into the dry air supplier 100 from the tub 2.

The water inside the tub 2 could flow into the dry air supplier 100 through the divider 160. In order to suppress water from excessively cumulating inside the housing 110 of the dry air supplier 100, a water outlet hole 111 may be formed in a lower surface of the housing 110.

Referring to FIG. 10B, the water outlet hole 111 may be formed in an appropriate number at an appropriate location on the floor of the lowest area of the housing 110. To smoothly discharge water from the housing 110, the plurality of water outlet holes 111 may be spaced a preset distance apart from each other in a longitudinal direction of the housing 110.

Accordingly, the water introduced into the housing 110 may flow to the bottom of the base 8 in which the dry air supplier 100 is disposed through the water outlet hole 111 formed in the lower surface of the housing 110.

When too much water accumulate on the bottom of the base 8, the water might be collected on the external floor of the location where the dishwasher is installed through a gap formed in the bottom surface of the base 8, which is a water leakage phenomenon.

When such water leakage occurs, the operation of the dishwasher may be stopped and the dishwasher is checked to find the cause of the water leakage and stop the water leakage.

If the controller provided in the dishwasher fails to detect the water leakage, the amount of the water leakage could increase enough to cause a malfunction or big convenience to the user.

Hereinafter, the structure of the present disclosure invented to solve the problem will be described.

The base 8 may include a water leak detection device 320 and a first inducing portion 330. The water leak detection device 320 may be disposed on the bottom of the base 8 and configured to detect water inflow. The water leak detection device 320 may be disposed at a position lower than the other area of the base 8 to allow the water introduced into the base 8 to fall therein by gravity.

The water leak detection device 320 may be provided in a manner of floating. The water leak detection device 320 may include a floater 321. When water is introduced into the water leak detection device 320, the floater 321 may float by buoyancy of the water and the water leak detection device 320 may determine the water leak.

The water leak detection device 320 may communicatively connected to the controller configured to control the operation of the dishwasher. Accordingly, the water leak detection device 320 may detect water leak that occurs on the bottom of the base 8 and transmit the detection of the water leak to the controller. The controller may determine presence of water leak on the bottom surface of the base 8.

When water leak occurs in the base 8, the controller may generate an alarm to notify the user. When the user notices occurrence of water leak, the user may stop the operation of the dishwasher and have the dishwasher inspected by himself/herself or another worker.

The first inducing portion 330 may be protruding toward the body, and configured to induce the water discharged from an upper surface of the body 210 to flow toward the water leak detection device 320. The first inducing portion 330 may be in communication with the body 210. Accordingly, the water discharged from the housing 110 of the dry air supply device 100 may fall to the upper surface of the body 210 of the cover 200 and flow along the first inducing portion 330 again.

An inlet of the first inducing portion 330 may be in communication with a second inducing portion 230 of the cover 200, which will be described later. An outlet of the first inducing portion 330 may be directed toward the water leak detection device 320. Accordingly, the flow path of the water flowing into the first inducing portion 330 may be induced by the first inducing portion 330 to be discharged to the water leak detection device 320.

The cover 200 may include a second inducing portion 230 protruding from the body 210 and disposed at a position corresponding to the first inducing portion 330, and may be configured to induce the water discharged from the dry air supply device 100 and falling to the upper surface of the body 210 to flow toward the first inducing portion 330.

Referring to FIG. 12, the upper surface of the second inducing portion 230 may be as high as a bottom surface of the water leak detection device 320, or it may be disposed at a position higher than the bottom surface of the water leak detection device 320. In this instance, the bottom surface of the water leak detection device 320 may be a surface that is formed in an area, where the floater 321 is coupled, to support a lower surface of the floater.

Accordingly, the water flowing into the second inducing portion 230 from the body 210 may flow to the bottom surface of the water leak detection device 320 positioned as high as or lower than the upper surface of the second inducing portion 230 by gravity.

The water on the upper surface of the cover 200 may be induced by the first inducing portion 330 and the second inducing portion 230 to be induced to the water leak detection device 320 so that the water leak detection device 320 may detect water leakage.

The first inducing portion 330 and the second inducing portion 230 may partially overlap in a vertical direction. The upper surface of the second inducing portion may be disposed higher than the upper surface of the first inducing portion 330.

The second inducing portion 230 of the cover 200 may be disposed on the upper surface of the first inducing portion 330 provided in the base 8. When the cover 200 is coupled to the base 8 through the opening 310, the second inducing portion 230 protruding from the cover 200 may be disposed on the upper surface of the first inducing portion 330. At this time, the first inducing portion 330 and the second inducing portion 230 may overlap at some area in a vertical direction of the base 8.

Due to this structure, the water discharged from the housing 110 may easily flow from the second inducing portion 230 of the cover 200 to the water leak detection device 320 along the second inducing portion 230 disposed in the base 8. Accordingly, when water flowing in and out from the housing 110, the discharged water may flow to the water leak detection device 320 immediately and the controller may find out that water leaks on the bottom of the base 8 after flowing into the housing 110 based on the detection of the water leak detection device 320.

Accordingly, it may be quickly detected that the water flowing into the dry air supply device 100 leaks on the bottom surface of the base 8 so that the user can immediately stop the operation of the dishwasher and take needed actions to repair the dry air supply device 100 and cut off further water leak.

The first inducing portion 330 may include a first region 331 and a second region 332. The first region 331 may be in communication with the second inducing portion 230 and configured to receive water from the second flow path of the cover 200. The second inducing portion 230 may be bent from the first region 331, with an end directed to the water leak detection device 320.

The water discharged from the second inducing portion 230 of the cover 200 may pass through the first region 331 and the second region 332 of the base 8, to flow into the water leak detection device 320.

The second inducing portion 230 may have a longitudinal direction that is disposed in a vertical direction so that a flow path of water flowing in the second inducing portion 230 may be toward a vertical direction of the base 8. An outlet of the second inducing portion 230 may be directed to the water leak detection device 320 and disposed adjacent to the water leak detection device 320.

The base 8 may include a first rib 340 protruding from each of both sides of the first inducing portion 330. The cover 200 may include a second rib 240 protruding from each of both sides of the second inducing portion 230 and at least some area of the second rib 240 may be disposed to overlap with the first rib 340.

The first rib 340 may be configured to block the water flowing along the upper surface of the first inducing portion 330 from deviating from the first inducing portion 330.

A pair of second ribs 240 may be disposed inside a pair of first ribs 340, respectively. At this time, the first ribs 340 and the second ribs 240 may overlap with each other, respectively, at some areas. The water flowing from the second inducing portion 230 to the first inducing portion 330 may not leak to the outside through a border area between the second inducing portion 230 and the first inducing portion 330 but smoothly flow along the first inducing portion 330.

The cover 200 may include a third rib 250 protruding from an upper surface of the cover 200, with an end connected to the second rib 240. The third rib may be connected to the second rib 240 and configured to surround the upper surface of the cover 200.

Accordingly, the water falling on the upper surface of the body of the cover 200 may flow to the second inducing portion 230 without the third rib 250, and may be blocked from leaking to the outside of the cover 200 through other areas except the second inducing portion 230 by the third rib 250.

The base 8 may include an upward protrusion 350 protruding upward from some area of the bottom surface of the base 8. A space may be formed in a lower surface of the upward protrusion 350 and a hose or various cables for water supply or discharge to the dishwasher from may be disposed in the space of the lower surface.

To form the space, the bottom surface of the base 8 may protrude upward to form the upward protrusion 350. Accordingly, the upward protrusion 350 may be positioned higher than the other area of the base 8.

When the cover 200 is mounted in the base 8, the upper surface of the cover 200 may be disposed higher than the lower end of the water leak detection device 320 so that it may be needed to smoothly flow the water falling and accumulating on the body 210 of the cover 200 to the water leak detection device 320.

To this end, the first inducing portion 330 and the first rib 340 may be formed to surround some area of the upper surface of the upward protrusion 350. Accordingly, the second inducing portion 230 and the second rib 240 may be disposed on the upper surface of the first inducing portion 330.

Due to this structure, the first inducing portion 330 may be positioned on the upper surface of the upward protrusion 350 that is a high position in the base 8, and the second inducing portion 230 may be positioned higher than the first inducing portion 330. Accordingly, a relatively large height difference may occur between the first inducing portion 330 and the lower end of the water leak detection device 320 so that the water may smoothly flow from the first inducing portion 330 to the water leak detection device 320 by gravity.

Figure 13A:
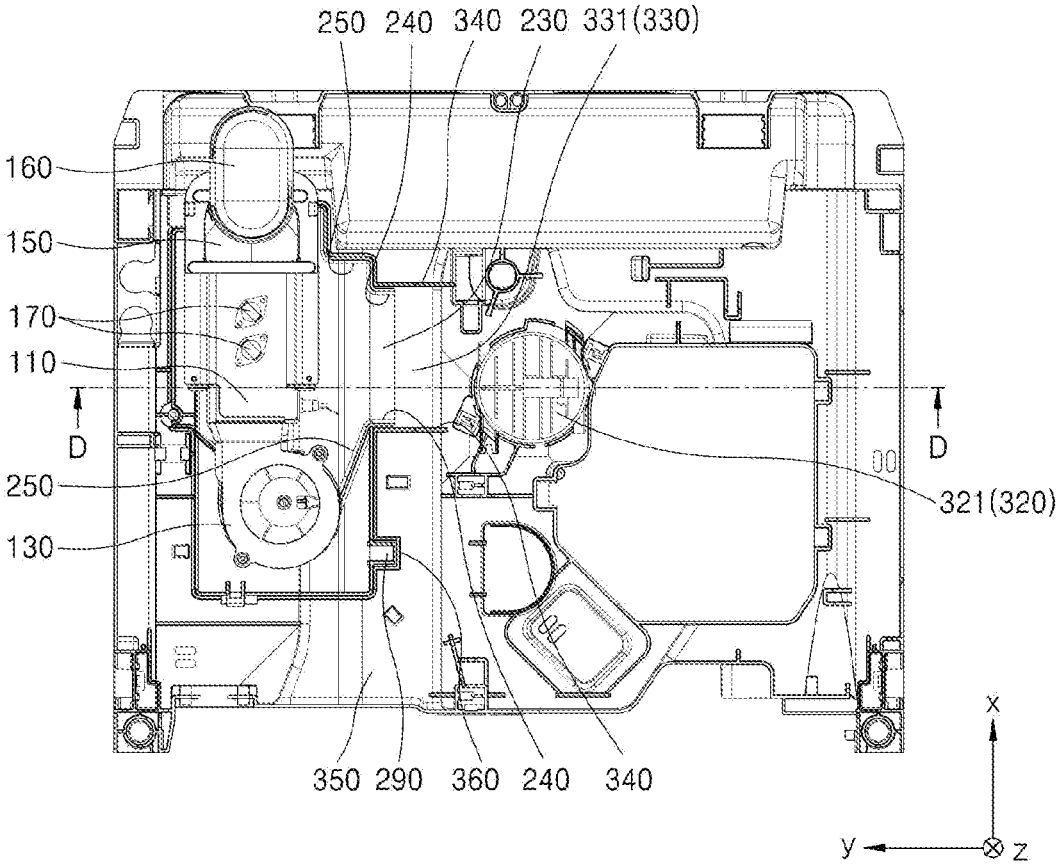
FIG. 13A is a plane view showing a base, omitting a bottom plate of a tub.
Figure 13B:
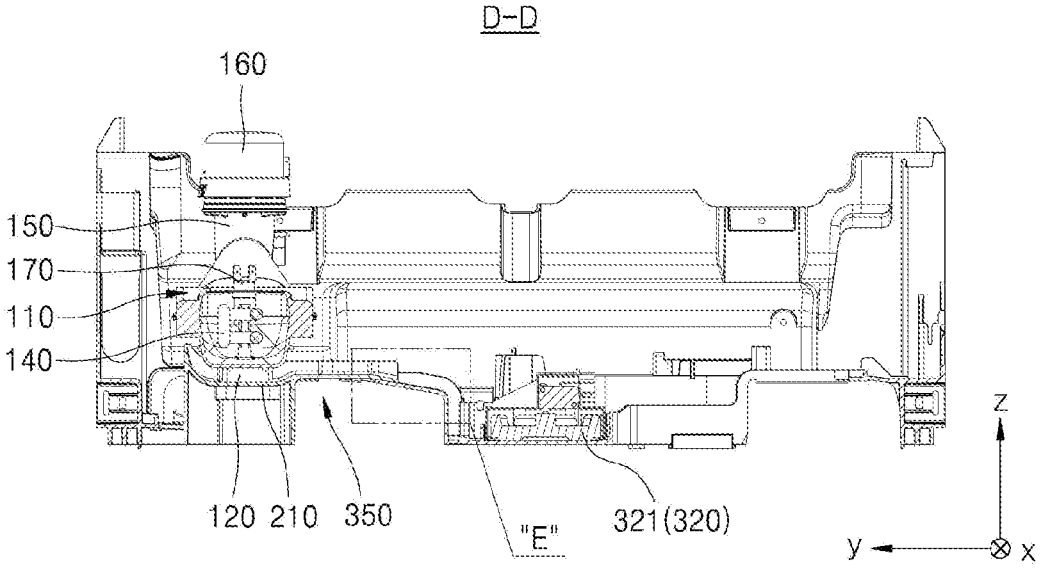
FIG. 13B is a sectional view cut away along 'DD' shown in FIG. 13A.
Figure 13C:
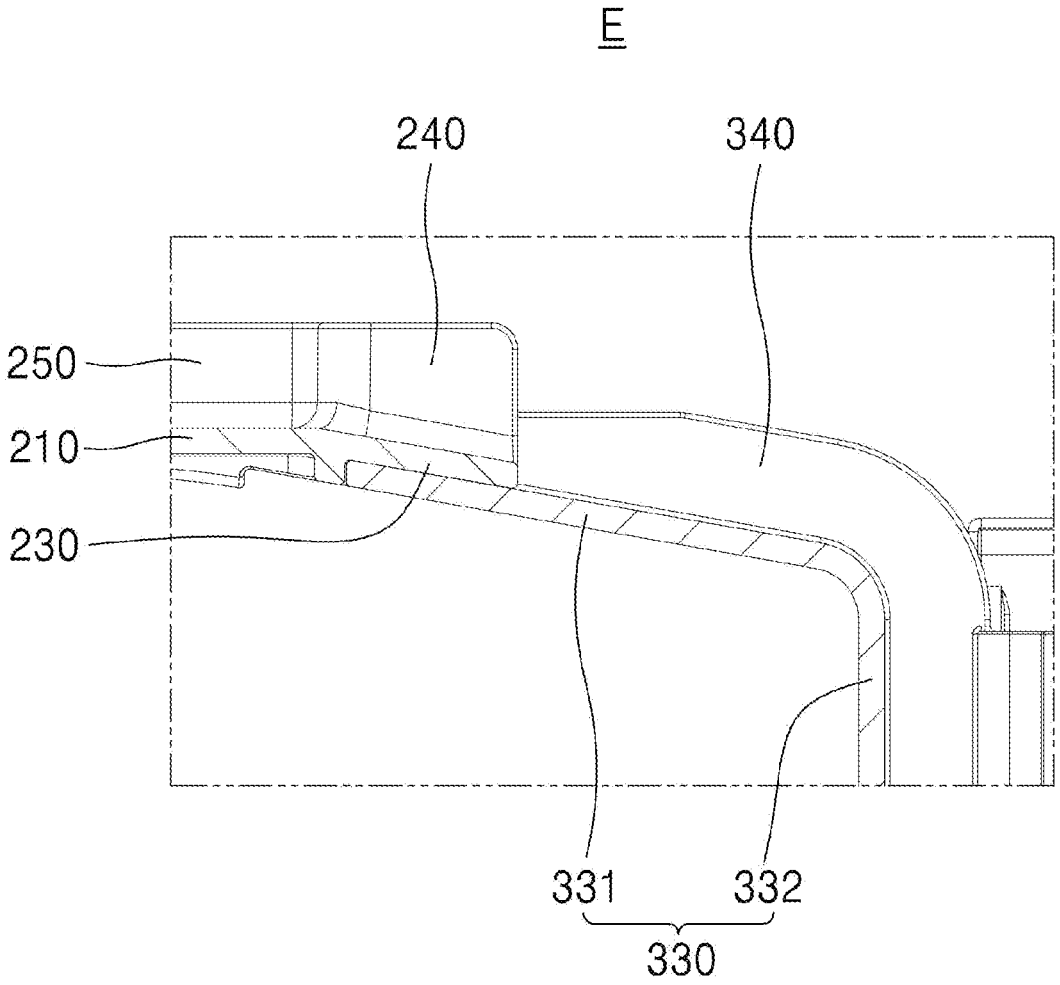
FIG. 13C is an enlarged view of 'E' shown in FIG. 13B.

FIG. 13A is a plane view showing a base, omitting a bottom plate 2*a* of a tub 2. FIG. 13B is a sectional view cut away along 'DD' shown in FIG. 13A. FIG. 13C is an enlarged view of 'E' shown in FIG. 13B.

Referring to FIG. 13C, the second inducing portion 230 may extend from the body 210, and may be inclined with respect to the body 210. The first region 331 may be inclined with respect to the body 210.

In this instance, the second inducing portion 230 and the first region 331 may have an inclined shape with an outlet that is downward, viewed in the water flow direction.

Even when a water level also may rise as the water accumulating on the upper surface of the body 210 increases, the water cannot flow in the direction in which the ribs 240 and 250 are located due to the ribs 240 and 250 protruding from the upper surface of the cover 200. However, since the ribs 240 and 250 are not formed in the direction of the water leak detection device 320 only to be open, the water may flow into the second inducing portion 230 disposed in the edge area of the body 210.

The second inducing portion 230 and the first region 331 of the first inducing portion 330 in communication with the second inducing portion 230 may have the inclined shape with the downward outlet, so that the water flowing in the second inducing portion 230 may smoothly flow along the second inducing portion 230 and the first region 331 by gravity to flow to the water leak detection device 320.

Figure 14:
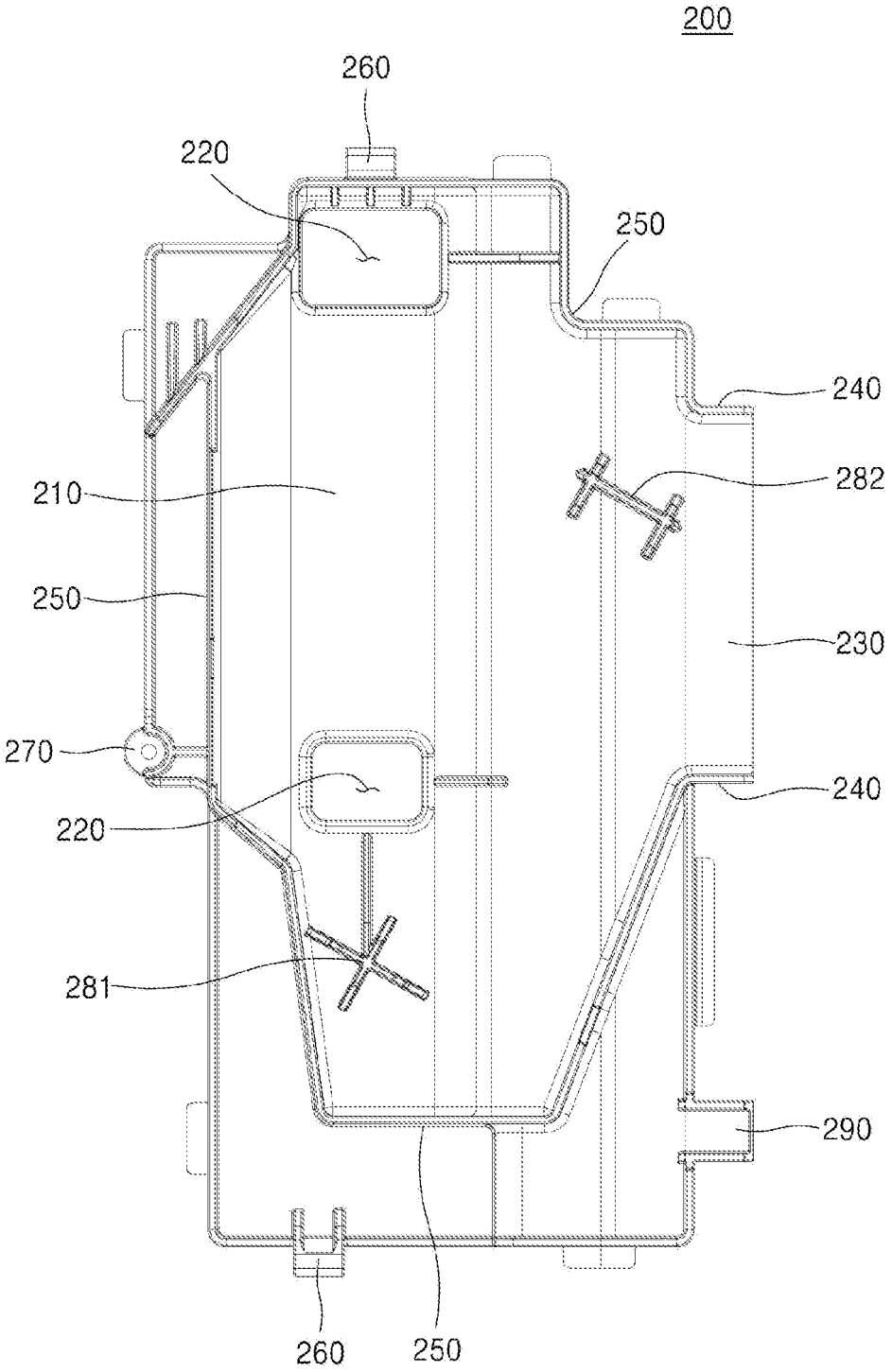
FIG. 14 is a plane view showing a cover according to an embodiment.
Figure 15:
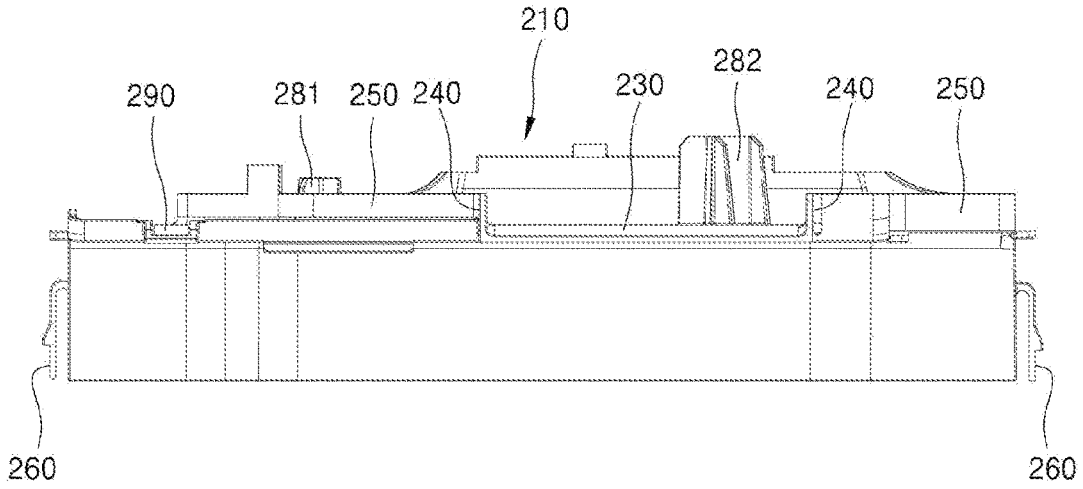
FIG. 15 is a plane view showing a cover according to an embodiment.
Figure 16:
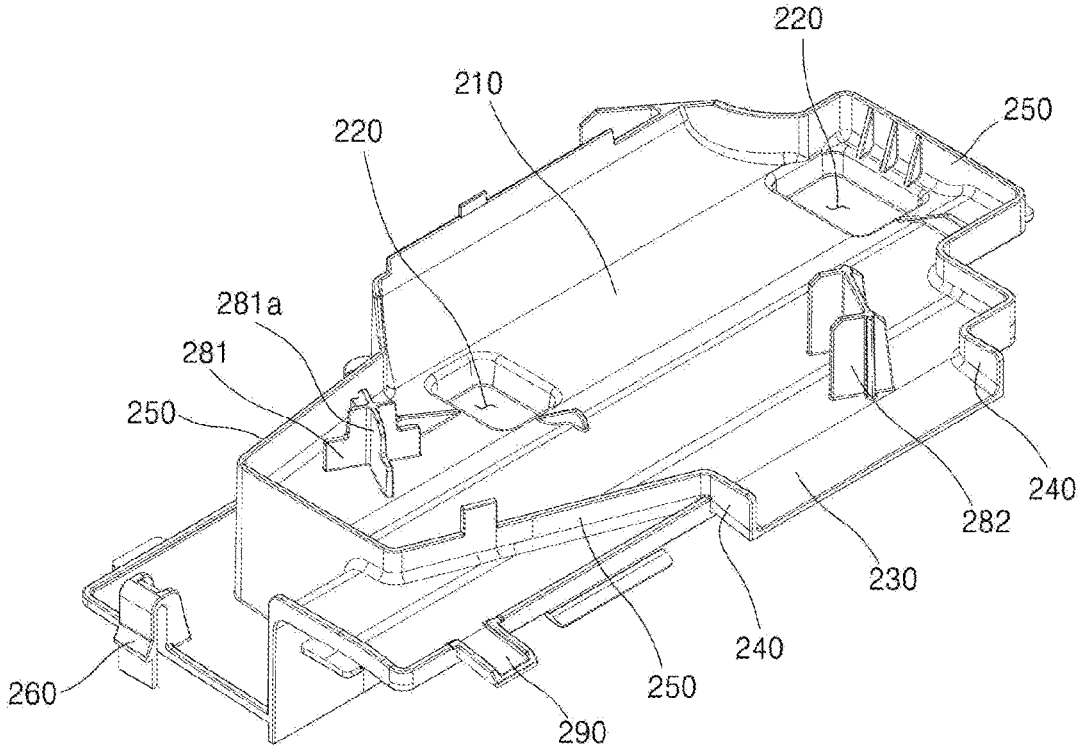
FIG. 16 is a perspective view showing a cover according to an embodiment.
Figure 17:
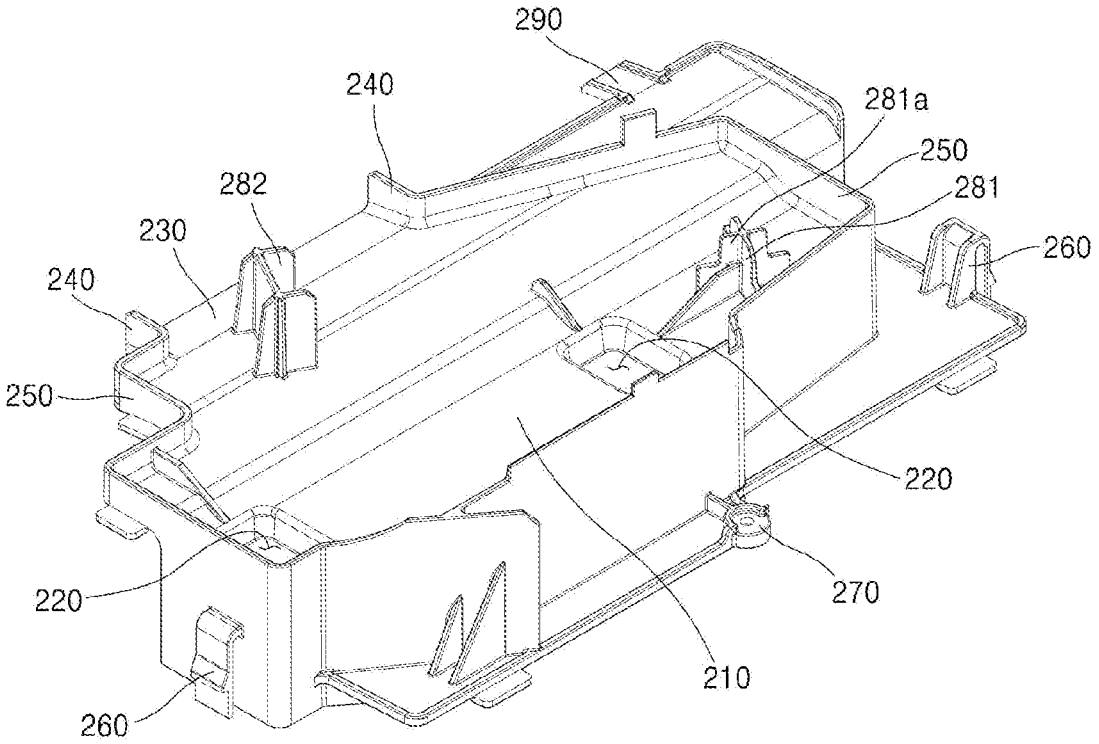
FIG. 17 is a view of FIG. 16, viewed from a different direction.

FIG. 14 is a plane view showing a cover 200 according to an embodiment. FIG. 15 is a plane view showing a cover 200 according to an embodiment. FIG. 16 is a perspective view showing a cover 200 according to an embodiment. FIG. 17 is a view of FIG. 16, viewed from a different direction.

The cover 200 may include a hook 260 and a coupling portion 270. At least one hook 260 may be provided in a lateral portion of the cover 200 and may be coupled to the base 8 by shape-fitting. A groove may be formed in the base 8 to couple the hook 260 thereto.

The hook 260 may be coupled to or decoupled from the groove as elastically deformed by a force applied by the worker. Since the hook 260 is provided, the worker may couple or decouple the cover 200 to or from the base 8 by using the hook 260, not using an auxiliary coupling member 270.

When the cover is mounted in the base 8, the second inducing portion 230 of the cover 200 may be disposed on the upper surface of the first inducing portion 330 of the base 8 as described above, and the first inducing portion 330 and the second inducing portion 230 may partially overlap each other.

The coupling portion 270 may stably couple the cover 200 to the base 8 while assisting the hook 260. The coupling portion 270 may be provided in a side of the cover 200 and spaced apart from the hook 260, to be coupled to the base 8 by a coupling member.

The coupling portion 270 may be protrude from the side of the cover 200 and a coupling hole to which the coupling member (e.g., a bolt) is coupled may be formed in the coupling portion 270.

A coupling member may be coupled to the coupling portion 270 to stably couple the cover 200 to the base 8. When using the coupling member in coupling the cover 200 to the base 8, stable coupling may be possible but it could take a long time to mount or demount the cover 200.

Due to this, the number of the coupling portions 270 need decreasing to easy coupling and decoupling of the cover 200. Accordingly, in an embodiment, the cover 200 may include one coupling portion 270 and two hooks 260, to maintain the state where the cover 200 is stably coupled to the base 8 and facilitate easy and quick coupling/decoupling work of the cover 200.

The cover 200 may include a first support protrusion 281 protruding from the upper surface of the body 210 and supportively seat the dry air supplier 100 thereon. The first support protrusion 281 may have a coupling end 281*a* formed at an end thereof.

The coupling end 281*a* may be formed to have a step with respect to a lower surface of the first support protrusion 281. A through-hole in which the coupling end 281*a* is inserted may be formed in the dry air supplier 100. The coupling end 281*a* may be fitted to the through-hole of the dry air supply device 100 so that the dry air supplier 100 may be temporarily mounted to the cover 200.

Accordingly, the first support protrusion 281 may be configured to temporarily secure the dry air supplier 100 to the cover 200, to serve a function of facilitating the mounting process between the dry air supplier 100 and the cover 200.

In a state where the coupling end 281*a* of the first support protrusion 281 is fitted to the dry air supplier 100, the worker can easily mount the dry air supplier 100 to the cover 200 by using the hook 260 and the coupling portion 270.

The cover 200 may include a guide protrusion 290 protruding from a side and to guide a position at which the cover 200 fitted to the base 8 is coupled to the base 8.

The base 8 may include a guide groove 360 (see FIG. 12) formed at a position corresponding to the guide protrusion 290 and configured to fittedly receive the guide protrusion 290.

When the cover 200 is mounted to the base 8, the cover 200 must be disposed at a predetermined position after inserted in the opening 310. If the cover 200 is not disposed at the predetermined position, the coupling between the cover 200 and the dry air supplier 100 could be difficult and the cover 200 could not be mounted to the base smoothly.

Accordingly, in an embodiment, the guide protrusion 290 may be formed in the cover 200 and the guide groove 360 may be formed in the base 8. The guide protrusion 290 and the guide groove 360 may be fitted together so that the cover 200 may be disposed at the predetermined position of the base 8.

The cover 200 may include a second support protrusion 282 protruding from the upper surface of the body 210, spaced apart from the first support protrusion 281, and configured to support a lateral surface of the dry air supplier 100.

When the dry air supplier 100 is put on the cover 200, the second support protrusion 282 may support one lateral surface of the dry air supplier 100. The second support protrusion 282 may protrude from the upper surface of the body 210. The position of the second support protrusion 282 may be arranged as a position supporting the lateral surface of the dry air supplier 100.

The assembling of the dry air supplier 100 will be performed as follows. The leg 120 of the dry air supplier 100 that is temporarily mounted to the first support protrusion 281 and the second support protrusion 282 of the cover may be transferred to a final assembler The final assembler may assemble the dry air supplier 100 to the tub 2 by separating the temporarily-mounted leg 120 of the dry air supplier 100 from the first support protrusion 281 and the second support protrusion 282. Finally, the leg 120 may be seated on the recess 220 of the cover 200 and the dry air supplier 100 may be finally assembled to the cover.

There is a need of separating the dry air supplier 100 from the base 8 to check or repair the dry air supplier 100. The assembly of the dry air supplier 100 may proceed as follows.

First, the operation of the dishwasher may be stopped and the door may be open, to take out a lower rack 51 provided in a lower area of the tub 2 from the tub 2.

Then, the divider 160 disposed below the tub 2 may be separated from the dry air supplier 100. At this time, a female thread may be formed in the divider 160 and a male tread may be formed in the upper area of the air outlet 150 of the dry air supplier 100 so that the divider 160 may be easily separated from the dry air supplier 100.

Hence, the dishwasher may be laid down to take out the dry air supplier 100. When the dishwasher is laid down, the bottom surface of the base 8 may be accessible and the cover 200 coupled to the base 8 may be separated.

The hook 260 of the cover 200 may be separated and the bolts fastened to the coupling portion 270 may be decoupled by using a tool such as a screwdriver. After that, the cover 200 may be separated from the base 8. Once the cover 200 is separated, the opening 310 provided in the bottom surface of the base 8 may be open.

Next, the dry air supplier 100 may be taken out from the inside of the base 8 through the opening 310. The dry air supplier 100 may be completely separated from the base 8 by disconnecting the wiring connected to the dry air supplier 100 taken out from the base 8.

Meanwhile, reassembly of the dry air supplier 100 may be performed in the reverse order of the disassembly. When the cover 200 is mounted to the dry air supplier 100 in the assembly process, as described above, the coupling between the cover 200 and the first support protrusion 281 may be smoothly performed by temporarily securing the dry air supplier 100 to the first support protrusion 281.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A dishwasher comprising:

a tub configured to receive objects to be cleaned, the tub comprising a bottom plate;

a base disposed below a lower side of the bottom plate of the tub, the base defining an opening at a bottom surface thereof;

a dry air supplier configured to spray air to the tub and disposed in a space defined between the base and the bottom plate of the tub, the dry air supplier being configured to be drawn out of the dishwasher through the opening of the base; and a cover configured to be coupled to the base to thereby close the opening of the base.

2. The dishwasher of claim 1, wherein the cover is configured to be coupled to and decoupled from the base.

3. The dishwasher of claim 2, wherein the dry air supplier is configured to, based on the cover being decoupled from the base, be separated from the base through the opening of the base.

4. The dishwasher of claim 1, wherein the dry air supplier comprises a housing that defines an air flow path, and wherein the cover comprises a body having an upper surface configured to support the dry air supplier.

5. The dishwasher of claim 4, wherein the dry air supplier comprises:

a ventilation fan disposed at the housing and configured to blow air introduced into the dry air supplier;

a heating part disposed inside the housing and configured to heat the air blown by the ventilation fan; and an air discharge part that is connected to the housing and in fluid communication with an air outlet of the housing, the air discharge part being configured to guide the air toward the tub.

6. The dishwasher of claim 4, wherein the base comprises:

a water leak detection device configured to detect water; and a first inducing portion that protrudes toward the body, the first inducing portion being configured to receive water discharged from the upper surface of the body and to guide the water into the water leak detection device.

7. The dishwasher of claim 6, wherein the cover comprises:

a second inducing portion that protrudes from the body and extends toward the first inducing portion, the second inducing portion being configured to receive water discharged from the dry air supplier and to guide the water from the upper surface of the body down to the first inducing portion.

8. The dishwasher of claim 7, wherein a height of an upper surface of the second inducing portion is greater than or equal to a height of a bottom surface of the water leak detection device.

9. The dishwasher of claim 7, wherein the first inducing portion and the second inducing portion are arranged along a vertical direction such that parts of the first inducing portion and the second inducing portion overlap with each other in the vertical direction, and wherein a bottom surface of the second inducing portion is disposed above an upper surface of the first inducing portion.

10. The dishwasher of claim 7, wherein the first inducing portion comprises:

a first region that is in fluid communication with the second inducing portion and configured to receive water from the cover; and a second region that is curved from the first region and has an end directed toward the water leak detection device.

11. The dishwasher of claim 10, wherein the second inducing portion extends from the body and is inclined with respect to the body.

12. The dishwasher of claim 11, wherein the first region of the first inducing portion is inclined with respect to the body, and wherein the second inducing portion and the first region of the first inducing portion are inclined downward with respect to the body to thereby discharge water in a direction downward with respect to a flow direction of water on the cover.

13. The dishwasher of claim 7, wherein the base further comprises a first rib that protrudes from sides of the first inducing portion, wherein the cover comprises a second rib that protrudes from sides of the second inducing portion, and wherein at least a portion of the second rib overlaps with the first rib.

14. The dishwasher of claim 13, wherein the cover further comprises a third rib that protrudes from an upper surface of the cover and has an end connected to the second rib.

15. The dishwasher of claim 13, wherein the base further comprises an upward protrusion that protrudes upward from the bottom surface of the base, and wherein the first inducing portion and the first rib cover an area of an upper surface of the upward protrusion.

16. The dishwasher of claim 7, wherein the cover further comprises:

a hook disposed at a lateral surface of the cover and configured to be coupled to the base by shape fitting; and a coupling portion spaced apart from the hook and configured to be coupled to base by a coupling tool.

17. The dishwasher of claim 16, wherein the cover further comprises a first support protrusion that protrudes from the upper surface of the body and is configured to support the dry air supplier.

18. The dishwasher of claim 17, wherein the cover further comprises a guide protrusion that protrudes from a surface of the cover and is configured to be coupled to the base, the guide protrusion being configured to guide a position of the cover based on the cover being coupled to the base, and wherein the base defines a guide groove configured to receive the guide protrusion such that the guide protrusion is fitted to the guide groove.

19. The dishwasher of claim 18, wherein the cover further comprises a second support protrusion that protrudes from the upper surface of the body and is spaced apart from the first support protrusion, the second support protrusion being configured to support a lateral surface of the dry air supplier.

20. The dishwasher of claim 4, wherein the dry air supplier comprises a leg that protrudes from the housing, and wherein the cover defines a recess that is recessed from the body and configured to support the leg.

* * * * *